US010082741B2

(12) United States Patent
Ishida et al.

(10) Patent No.: US 10,082,741 B2
(45) Date of Patent: Sep. 25, 2018

(54) MEMBER FOR ELECTROPHOTOGRAPHY, DEVELOPING APPARATUS, AND ELECTROPHOTOGRAPHIC APPARATUS

(71) Applicant: CANON KABUSHIKI KAISHA, Tokyo (JP)

(72) Inventors: Kazutoshi Ishida, Mishima (JP); Yuji Sakurai, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 22 days.

(21) Appl. No.: 15/269,135

(22) Filed: Sep. 19, 2016

(65) Prior Publication Data

US 2017/0097580 A1 Apr. 6, 2017

(30) Foreign Application Priority Data

Oct. 6, 2015 (JP) ..... 2015-198374

(51) Int. Cl.
*G03G 5/04* (2006.01)
*G03G 15/08* (2006.01)

(52) U.S. Cl.
CPC ..... *G03G 5/04* (2013.01); *G03G 15/0818* (2013.01); *G03G 2215/0141* (2013.01)

(58) Field of Classification Search
CPC ..... C08F 22/105; G03G 15/06–15/11; G03G 15/0818
See application file for complete search history.

(56) References Cited

U.S. PATENT DOCUMENTS

| | | | | |
|---|---|---|---|---|
| 5,610,695 | A * | 3/1997 | Mizutani | G03G 15/0818 399/284 |
| 6,725,002 | B2 | 4/2004 | Sakurai et al. | |
| 7,201,967 | B2 | 4/2007 | Sakurai et al. | |
| 7,798,948 | B2 | 9/2010 | Kawamura et al. | |
| 7,979,004 | B2 | 7/2011 | Tanaka et al. | |
| 8,600,273 | B2 | 12/2013 | Yamada et al. | |
| 8,660,472 | B2 | 2/2014 | Kurachi et al. | |
| 8,706,011 | B2 | 4/2014 | Anan et al. | |
| 8,768,226 | B2 | 7/2014 | Koyanagi et al. | |
| 8,774,677 | B2 | 7/2014 | Sakurai et al. | |
| 8,798,508 | B2 | 8/2014 | Yamada et al. | |

(Continued)

FOREIGN PATENT DOCUMENTS

| | | | |
|---|---|---|---|
| JP | 56051753 | A * | 5/1981 |
| JP | H04-050877 | | 2/1992 |
| JP | H04-088381 | | 3/1992 |

*Primary Examiner* — Ramsey E Zacharia
(74) *Attorney, Agent, or Firm* — Fitzpatrick Cella Harper and Scinto

(57) ABSTRACT

Provided is a member for electrophotography that enables stable formation of a high-quality electrophotographic image even when used as a developing member over a long period of time. The member for electrophotography includes: a support; an electro-conductive elastic layer on the support; and a plurality of electrically insulating domains on the electro-conductive elastic layer, in which a surface of the member for electrophotography includes surfaces of the electrically insulating domains and an exposed portion of the electro-conductive elastic layer free of being covered by the electrically insulating domains, and in which the electrically insulating domains each contain a resin having a specific structure.

6 Claims, 3 Drawing Sheets

(56) References Cited

U.S. PATENT DOCUMENTS

| | | | |
|---|---|---|---|
| 8,837,985 | B2 | 9/2014 | Ishida et al. |
| 8,846,287 | B2 | 9/2014 | Yamada et al. |
| 9,017,239 | B2 | 4/2015 | Ishida et al. |
| 9,482,986 | B2 | 11/2016 | Sakurai et al. |
| 2006/0067747 | A1 | 3/2006 | Matsuda et al. |
| 2006/0226572 | A1 | 10/2006 | Tanaka et al. |
| 2013/0130022 | A1 | 5/2013 | Uesugi et al. |

* cited by examiner

MEMBER FOR ELECTROPHOTOGRAPHY, DEVELOPING APPARATUS, AND ELECTROPHOTOGRAPHIC APPARATUS

BACKGROUND OF THE INVENTION

Field of the Invention

The present invention relates to a member for electrophotography, a developing apparatus, and an electrophotographic apparatus.

Description of the Related Art

In Japanese Patent Application Laid-Open No. H04-50877, there is a disclosure of an example of a developer-carrying member to be suitably used in an electrophotographic image-forming method involving using a nonmagnetic one-component developer. Specifically, there is a disclosure of a developer-carrying member capable of carrying a large amount of a nonmagnetic one-component developer by forming many minute closed electric fields (microfields) in the vicinity of its surface.

One embodiment of the present invention is directed to the provision of a member for electrophotography that does not cause a reduction in image density even when used as a member in a printer for a long period of time. In addition, other embodiments of the present invention are directed to the provision of a developing apparatus and an electrophotographic apparatus each capable of stably forming a high-quality electrophotographic image.

SUMMARY OF THE INVENTION

According to one embodiment of the present invention, there is provided a member for electrophotography, including:

a support;

an electro-conductive elastic layer on the support; and a plurality of electrically insulating domains on the electro-conductive elastic layer, in which a surface of the member for electrophotography includes:

surfaces of the electrically insulating domains; and an exposed portion of the electro-conductive elastic layer free of being covered by the electrically insulating domains, and in which the electrically insulating domains contain a resin, the resin having a structure represented by the following structural formula (1):

$A_nR$ Structural Formula (1)

in the structural formula (1), A represents a structure represented by the following structural formula (2), n represents an integer of 2 or more, and R represents a linking group that links n pieces of A:

Structural formula (2)

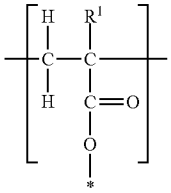

in the structural formula (2), $R^1$ represents a hydrogen atom or a methyl group, and symbol "*" represents a bonding site with the linking group R.

According to another embodiment of the present invention, there is provided a member for electrophotography, including:

a support;

an electro-conductive elastic layer on the support; and a plurality of electrically insulating domains on the electro-conductive elastic layer, in which a surface of the member for electrophotography includes:

surfaces of the electrically insulating domains; and an exposed portion of the electro-conductive elastic layer free of being covered by the electrically insulating domains, and in which the electrically insulating domains each contain a resin, the resin having a structure in which at least two units each represented by the following structural formula (2) are bonded by a linking group R:

Structural formula (2)

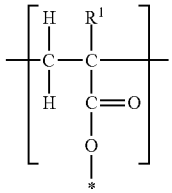

in the structural formula (2), $R^1$ represents a hydrogen atom or a methyl group, and symbol "*" represents a bonding site with the linking group R.

According to another embodiment of the present invention, there is provided a developing apparatus, including a developing roller, in which the developing roller includes the above-mentioned member for electrophotography.

According to another embodiment of the present invention, there is provided an electrophotographic apparatus, including:

a photosensitive drum; and a developing roller configured to supply a developer to the photosensitive drum, in which the developing roller includes the above-mentioned member for electrophotography.

Further features of the present invention will become apparent from the following description of exemplary embodiments with reference to the attached drawings.

DESCRIPTION OF THE EMBODIMENTS

Figure 1A:
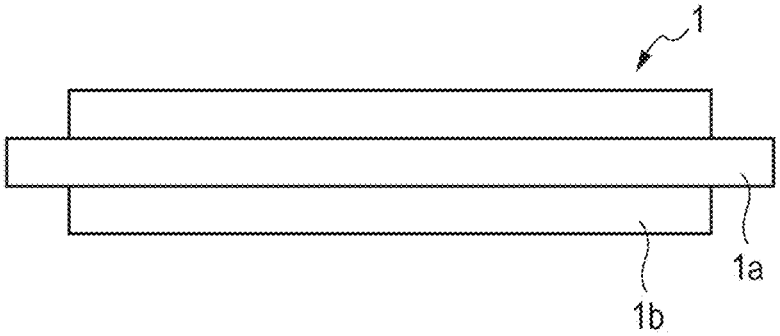
FIG. 1A is a sectional view of a roller-shaped member for electrophotography according to one embodiment of the present invention as cut in a direction along its longitudinal direction.

Preferred embodiments of the present invention will now be described in detail in accordance with the accompanying drawings.

The inventors of the present invention performed the formation of an electrophotographic image over a long period of time with the use of the developer-carrying member disclosed in Japanese Patent Application Laid-Open No. H04-50877. As a result, the density of the electrophotographic image was gradually reduced in some cases.

An investigation made by the inventors of the present invention suggests that the reduction in density of the electrophotographic image is due to a reduction in volume, through abrasion, of a dielectric portion that is present in the surface of the developer-carrying member and that causes a minute closed electric field. That is, the reduction in volume of the dielectric portion reduces the amount of charge that can be accumulated in the dielectric portion. As a result, a Coulomb force and a gradient force that are generated by the charge accumulated in the dielectric portion are reduced to reduce the amount of toner that the dielectric portion can convey. The inventors have presumed that the reduction in density of the electrophotographic image is thus caused.

In view of the foregoing, the inventors of the present invention have made further investigations in order to obtain a dielectric portion in which charge can be stably accumulated even during long-term use. As a result, the inventors have found that an electrically insulating domain, hereinafter referred as "insulating domain", containing a resin having a structure represented by the structural formula (1) allows the above-mentioned object to be achieved in a satisfactory manner.

$A_nR$ Structural formula (1)

In the structural formula (1), "A" represents a structure represented by the following structural formula (2), n represents an integer of 2 or more, and "R" represents a linking group that links n pieces of A.

Structural formula (2)

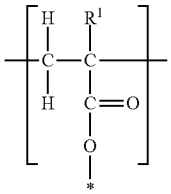

In the structural formula (2), $R^1$ represents a hydrogen atom or a methyl group, and symbol "*" represents a bonding site with the linking group R.

More specifically, the resin contained in the dielectric portion has a structure in which at least two units each represented by the structural formula (2) are bonded by the linking group R.

In the structural formula (1), "n" represents an integer of 2 or more, preferably an integer of from 2 to 25. When n has such numerical value, the resin contained in the domain has a denser crosslinked structure, and hence the abrasion resistance of the domain can be further improved.

In addition, the linking group R is preferably an n-valent group of atoms having 2 or more carbon atoms and bonded to an oxygen atom of A. With this, the volume resistivity of the resin in the domain can be enhanced more.

The resin having the structure represented by the structural formula (1) is obtained by polymerizing a compound having two or more acryloyl groups or methacryloyl groups in the molecule. Examples of such compound are given below.

1,3-Butylene glycol diacrylate, 1,4-butanediol diacrylate, 1,6-hexanediol diacrylate, neopentyl glycol diacrylate, cyclohexanedimethanol diacrylate, ethoxylated bisphenol A diacrylate, tricyclodecanedimethanol diacrylate, trimethylolpropane triacrylate, pentaerythritol triacrylate, pentaerythritol tetraacrylate, and dipentaerythritol hexaacrylate.

When a compound having a structure containing neither an ethylene oxide skeleton nor a propylene oxide skeleton in the molecule is used, a resin having high volume resistivity is easily obtained. In addition, one kind of those compounds may be used alone, or two or more kinds thereof may be used in combination.

As required, a monofunctional (meth)acrylate may be used. Examples of such compound are given below.

4-tert-Butylcyclohexanol acrylate, stearyl acrylate, lauryl acrylate, 2-phenoxyethyl acrylate, isodecyl acrylate, isooctyl acrylate, isobornyl acrylate, and 4-ethoxylated nonylphenol acrylate.

As a method of polymerizing the compound having acryloyl groups or methacryloyl groups, for example, there is given a method involving adding a polymerization initiator to the compound, followed by curing through irradiation with ultraviolet light. With regard to the blending amount of the polymerization initiator, the polymerization initiator is preferably added at from 0.5 part by mass to 10 parts by mass with respect to 100 parts by mass of the total amount of the compound having acryloyl groups or methacryloyl groups.

Specific examples of the polymerization initiator are given below. One kind of the polymerization initiators may be used alone, or two or more kinds thereof may be used in combination.

2,2-Dimethoxy-1,2-diphenylethan-1-one, 1-hydroxycyclohexyl phenyl ketone, 2-hydroxy-2-methyl-1-phenylpropan-1-one, 1-[4-(2-hydroxyethoxy)-phenyl]-2-hydroxy-2-methyl-1-propan-1-one, 2-hydroxy-1-{4-[4-(2-hydroxy-2-methylpropionyl)-benzyl]-phenyl}-2-methylpropan-1-one, 2-methyl-1-[4-(methylthio)phenyl]-2-morpholinopropan-1-one, 2-benzyl-2-dimethylamino-1-(4-morpholinophenyl)-butan-1-one, 2-dimethylamino-2-(4-methylbenzyl)-1-(4-morpholin-4-yl-phenyl)-butan-1-one, bis(2,4,6-trimethylbenzoyl)-phenylphosphine oxide, 2,4,6-trimethylbenzoyl-diphenylphosphine oxide.

As a light source for the ultraviolet light, there are given a LED lamp, a high-pressure mercury lamp, a metal halide lamp, and a xenon lamp. A required cumulative light quantity may be appropriately adjusted in accordance with the kind of the (meth)acrylate compound to be used, and the kind and addition amount of the polymerization initiator.

The linking group R of the structural formula (1) preferably has a hydrocarbon structure having 4 or more carbon atoms. A known hydrocarbon structure may be used as long as the linking group R has 4 or more carbon atoms. When the number of carbon atoms of the linking group R is set to 4 or more, the volume resistivity of the resin can be increased, and even when the insulating domain is worn to some degree during use, an electric field can be sufficiently maintained to suppress a reduction in image density.

The linking group R preferably contains an oligomer component of at least one kind of resin selected from the group consisting of polyurethane, polyester, polyolefin, an epoxy resin, and polybutadiene. When the linking group R contains such oligomer component, an insulating domain having high volume resistivity and having toughness is obtained, and hence the abrasion amount of the insulating domain is suppressed, and moreover, even when the insulating domain is worn to some degree, an electric field can be maintained to suppress a reduction in image density.

When the linking group R contains the oligomer component of polyurethane, a polyether-based polyol, a polyester-based polyol, a polycarbonate-based polyol, or the like may be used as a polyol component, and an isocyanate component to be used may also be a known one.

In addition, when the linking group R contains the oligomer component of an epoxy resin, a known component may be used, and examples thereof include: a bisphenol-based component of a bisphenol A type or a bisphenol F type; and a novolac-based component of a phenol novolac type or a cresol novolac type.

The linking group R preferably has one or more aromatic or alicyclic structures. When the linking group R has an aromatic or alicyclic structure, the volume resistivity of the insulating domain can be further enhanced as compared to the case where the linking group R does not have any aromatic or alicyclic structure. In addition, the insulating domain can be made harder. As a result, the abrasion of the insulating domain is further suppressed even during long-term use of the member for electrophotography, and moreover, even when the insulating domain is abraded, an electric field is sufficiently maintained, and hence a reduction in image density can be suppressed.

Examples of the compound having an aromatic or alicyclic structure include ethoxylated bisphenol A diacrylate and tricyclodecanedimethanol diacrylate.

An example of the linking group R is a dendrimer. The dendrimer is a polymer formed of a structure in which a molecular chain is branched with high regularity (high-regularity branched polymer). The dendrimer has a polymer structure regularly branching from the center of a molecule. Accordingly, as its molecular weight increases, the dendrimer adopts a more spherical molecular form because of extreme steric crowding of branch terminals to be produced.

In addition, other examples of the linking group R include the structural formula 3-1 to the structural formula 3-9 shown below. In the structural formula 3-1 to the structural formula 3-9, "*" represents a bonding site with "A" in the structural formula (1).

(Structural formula 3-1)

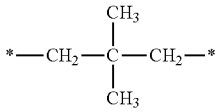

(Structural formula 3-2)

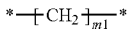

In the structural formula 3-2, m1 represents an integer of 2 or more and 10 or less.

(Structural formula 3-3)

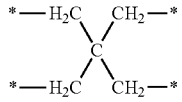

(Structural formula 3-4)

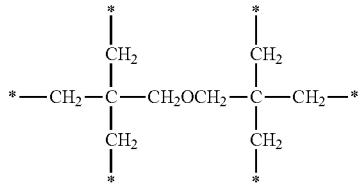

(Structural formula 3-5)

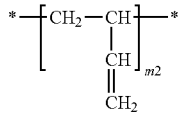

In the structural formula 3-5, m2 represents an integer of 15 or more and 60 or less.

(Structural formula 3-6)

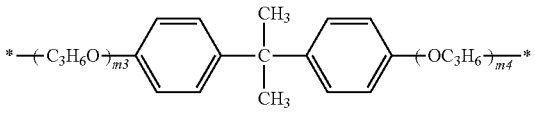

In the structural formula 3-6, m3 and m4 each represent an integer of 1 or more and 20 or less, provided that m3+m4=2 or more and 30 or less.

(Structural formula 3-7)

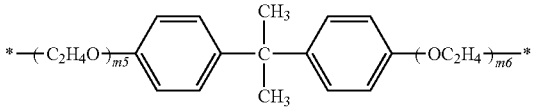

In the structural formula 3-7, m5 and m6 each represent an integer of 1 or more and 20 or less, provided that m5+m6=2 or more and 30 or less.

(Structural formula 3-8)

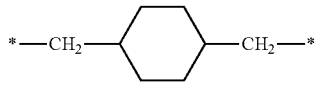

(Structural formula 3-9)

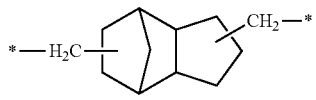

Now, a member for electrophotography according to one embodiment of the present invention is described. However, the present invention is not limited to this embodiment.

The member for electrophotography according to this embodiment includes a support and an electro-conductive elastic layer on the support. Such member for electrophotography is used as, for example, a roller-shaped developing member (hereinafter sometimes referred to as "developing roller"), a roller-shaped charging member (hereinafter sometimes referred to as "charging roller"), or a roller-shaped transfer member (hereinafter sometimes referred to as "transfer roller") in an electrophotographic apparatus.

Figure 1B:
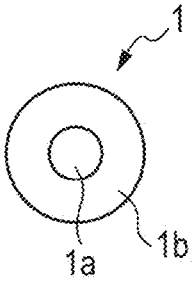
FIG. 1B is a sectional view of the roller-shaped member for electrophotography according to the one embodiment of the present invention as cut in a direction orthogonal to its longitudinal direction.

FIG. 1A and FIG. 1B are each a sectional view of a member 1 for electrophotography having a roller shape (hereinafter sometimes referred to as "roller 1 for electrophotography") according to one embodiment of the present invention.

FIG. 1A is a sectional view of the roller 1 for electrophotography as cut in a direction along with the longitudinal direction of a mandrel 1*a*. In addition, FIG. 1B is a sectional view of the roller 1 for electrophotography as cut in a direction orthogonal to the longitudinal direction of the mandrel 1*a*.

In addition, the roller for electrophotography 1 includes the mandrel 1*a* and an elastic layer 1*b* on the outer periphery of the mandrel 1*a*.

The elastic layer 1*b* has a plurality of insulating domains (hereinafter sometimes referred to as "dielectric portions") in its surface on the opposite side to its surface on the side opposed to the mandrel 1*a*, that is, a surface constituting the outer surface of the roller for electrophotography. In addition, the insulating domains and part of an electro-conductive elastic layer (hereinafter sometimes referred to as "electro-conductive portion") are exposed at the outer surface of the roller for electrophotography.

In other words, the outer surface of the roller for electrophotography includes surfaces of insulating domains 1*c*, and an exposed portion of the electro-conductive elastic layer free of being covered by the insulating domains.

Herein, the dielectric portions each have a volume resistivity of, for example, $1.0\times10^{13}$ Ω·cm or more, and an electro-conductive portion 1*d* has a volume resistivity of, for example, $1.0\times10^{12}$ Ω·cm or less.

In addition, as described above, the dielectric portions each contain the resin having the structure represented by the structural formula (1).

Figure 2:
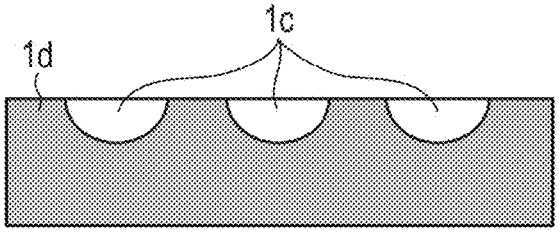
FIG. 2 is a sectional view of a member for electrophotography according to one embodiment of the present invention.
Figure 3:
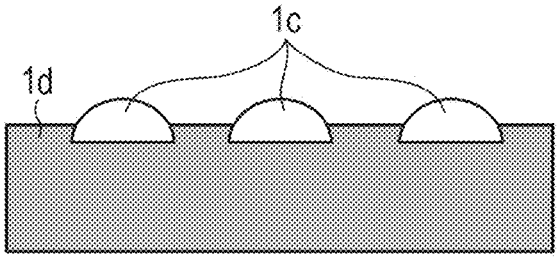
FIG. 3 is a sectional view of a member for electrophotography according to one embodiment of the present invention.
Figure 4:
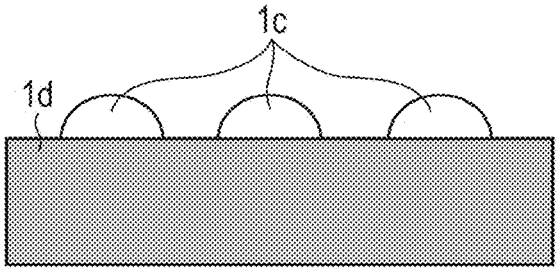
FIG. 4 is a sectional view of a member for electrophotography according to one embodiment of the present invention.

FIG. 2, FIG. 3, and FIG. 4 are each a schematic sectional view of the vicinity of the surface of the member for electrophotography according to the present invention. In FIG. 2, there is illustrated a construction in which the insulating domains 1*c* are embedded in the electro-conductive portion 1*d*. In FIG. 3, there is illustrated a construction in which the insulating domains 1*c* are partly embedded in the electro-conductive portion 1*d*. Further, in FIG. 4, there is illustrated a construction in which the insulating domains 1*c* are arranged on the surface of the electro-conductive portion 1*d*.

The sectional shape of each of the insulating domains 1*c* is not limited to the shapes illustrated in FIG. 2, FIG. 3, and FIG. 4. The area ratio (DA/MA) of the area (DA) of the insulating domains 1*c* included in the outer surface of the roller for electrophotography to the area (MA) of the portion of the electro-conductive elastic layer free of being covered by the insulating domains 1*c* preferably falls within the range of from 2/8 to 8/2. When the area ratio is set to fall within this range, electric fields are efficiently generated between the dielectric portions and the electro-conductive portion 1*d*, and a Coulomb force and a gradient force can be enhanced more. As a result, the toner-conveying force provided by the insulating domains 1*c* can be further improved.

The shape of each of the insulating domains 1*c* as observed in the outer surface of the roller for electrophotography is not particularly limited, but may be, for example, a circular shape like a true circle or an ellipse, or a polygonal shape like a square, a rectangle, a pentagon, or a hexagon. The shape of each of the insulating domains 1*c* is defined as the shape of an image of the insulating domain 1*c* orthographically projected on the surface of the support.

In addition, when the shape of each of the insulating domains 1*c* is a circular shape, the size of each of the insulating domains 1*c* is preferably 10 μm or more and 300 μm or less in terms of circle equivalent diameter. In addition, when the shape of each of the insulating domains 1*c* is a polygonal shape, the size is preferably 10 μm or more and 300 μm or less on a side.

Further, an interval between the insulating domains 1*c* is preferably 20 μm or more and 200 μm or less. When the size and interval of the insulating domains 1*c* in the outer surface are set to fall within the above-mentioned ranges, electric fields can be efficiently generated to accumulate charge in the insulating domains 1*c* more efficiently.

In addition, the thickness of the insulating domains as observed in the section of the vicinity of the surface illustrated in each of FIG. 2, FIG. 3, and FIG. 4 is preferably at least 5 m or more at the thickest portion. With this, strong electric fields can be more reliably generated between the insulating domains 1*c* and the electro-conductive portion 1*d*, and hence a Coulomb force and a gradient force that allow a sufficient amount of toner to be conveyed can be generated.

As a production method for the roller for electrophotography in which the dielectric portions and the electro-conductive portion 1*d* are exposed at the outer surface, for example, the following methods are given:

1) a method involving polishing the surface of the electro-conductive elastic layer having dispersed therein electrically insulating particles to expose at least part of the electrically insulating particles, thereby forming the insulating domains;

2) a method involving forming concave portions in the surface of the electro-conductive elastic layer, and then pouring a material for insulating domain formation having fluidity into only the concave portions, followed by curing of the material to form the insulating domains; and 3) a method involving placing a material for insulating domain formation on the surface of the electro-conductive elastic layer in the form of dots by screen printing, a jet dispenser, or the like, and curing the material to form the insulating domains.

The resin for forming the insulating domains preferably has an extraction amount of 15% or less when extracted with methyl ethyl ketone (MEK). When the extraction amount is adjusted to 15% or less, the resin has a high degree of crosslinking. Accordingly, a resin having high abrasion resistance is obtained, and the wear amount of the insulating domains can be suppressed. As a method of adjusting the extraction amount to 15% or less, for example, there is given a method involving increasing the ratio of the compound having two or more acryloyl groups or methacryloyl groups in the materials to be used.

Specifically, it is preferred that M1 and M2 satisfy a relationship represented by the numerical expression (1), where M2 represents the mass of a residue obtained by subjecting the insulating domains having a mass M1 to reflux in a Soxhlet extractor for 36 hours using methyl ethyl ketone as a solvent, and removing the methyl ethyl ketone from the resultant extract solution.

$$(M2/M1)*100\leq15 \qquad \text{Numerical expression (1)}$$

It is preferred that part or all of the insulating domains be each formed in a convex shape with respect to the electro-conductive portion. When part or all of the insulating domains are each formed in a convex shape, a physical conveying force is applied as well as a Coulomb force and a gradient force, and hence the image density can be made higher.

(Mandrel)

Any mandrel capable of functioning as an electrode and supporting member (support) of the member for electrophotography in its use as a roller for electrophotography may be applied to the present invention, and a hollow or solid mandrel may be appropriately used. In addition, for example, metals or alloys, such as aluminum, copper, stainless steel, and iron, and electro-conductive materials, such as an electro-conductive synthetic resin, may each be used as a material for the mandrel.

(Elastic Layer)

The elastic layer is a layer for imparting elasticity to the roller for electrophotography in order to achieve an appropriate area of contact at the time of pressure contact with a photosensitive drum or a toner-regulating member, and the elastic layer may be a single layer or a plurality of layers as long as such purpose is achieved.

In addition, the elastic layer to be used in the present invention may be produced using a known material for a roller for electrophotography, and, for example, the following rubbers and electro-conductive agents may each be used as a material for the elastic layer.

Examples of the rubber are shown below.

An ethylene-propylene-diene copolymer rubber (EPDM), an acrylonitrile-butadiene rubber (NBR), a chloroprene rubber (CR), a natural rubber (NR), an isoprene rubber (IR), a styrene-butadiene rubber (SBR), a fluororubber, a silicone rubber, an epichlorohydrin rubber, a butadiene rubber (BR), a hydrogenated product of NBR, a polysulfide rubber, and a urethane rubber.

The silicone rubber and the epichlorohydrin rubber are particularly preferred from the viewpoint of a reduction in hardness of the elastic layer. However, the rubbers each involve the following problem: a low-molecular weight component or a plasticizer is liable to bleed as an extracted component. The elastic layer may use one kind of those rubbers alone, or may use a mixture of several kinds thereof.

As an electro-conductive agent to be blended into the elastic layer, for example, an ion conductive agent or carbon black may be used, and the electro-conductive agent may be used without any particular limitation. Examples of the carbon black include acetylene black and furnace black each having high electro-conductivity, such as SAF, ISAF, HAF, MAF, FEF, GPF, and SRF. The resistance of the elastic layer is preferably from $1.0\times10^{2}$ Ω·cm to $1.0\times10^{13}$ Ω·cm. Accordingly, the addition amount of the carbon black is set to preferably 1 part by mass or more and 80 parts by mass or less, more preferably 2 parts by mass or more and 70 parts by mass or less with respect to 100 parts by mass of the rubber.

Further, as required, another electro-conductive agent may be used in combination with the carbon black. Examples thereof include: graphite; various electro-conductive metals or alloys, such as aluminum, copper, tin, and stainless steel; and metal oxides obtained by subjecting tin oxide, zinc oxide, indium oxide, titanium oxide, a tin oxide-antimony oxide solid solution, and the like to various electro-conductivity-imparting treatments. The volume resistivity of the roller for electrophotography is preferably from $1.0\times10^{2}$ Ω·cm to $1.0\times10^{12}$ Ω·cm. Accordingly, the addition amount of such other electro-conductive agent is set to preferably 2 parts by mass or more and 20 parts by mass or less, more preferably 5 parts by mass or more and 18 parts by mass or less with respect to 100 parts by mass of the rubber.

When the electro-conductive agent is added to the rubber, the rubber having electro-conductivity imparted thereto serves as the electro-conductive portion. Accordingly, the roller of the present invention in which the insulating domains and the electro-conductive portion are exposed can be produced by adding electrically insulating particles to the rubber in advance, followed by polishing, or by forming domains on the rubber having electro-conductivity imparted thereto with an electrically insulating material or the like.

In addition, various other known additives for rollers for electrophotography may be used. For example, a reinforcing agent, such as hydrophilic silica, hydrophobic silica, quartz, calcium carbonate, aluminum oxide, zinc oxide, or titanium oxide, or a heat transfer-improving agent may be added as required.

As a production method involving arranging the elastic layer on the mandrel, a known method for a roller for electrophotography may be used. Examples of such production method are given below:

1) a method involving coextruding the mandrel and a material for the elastic layer to mold the elastic layer; and 2) a method involving injecting, when the material for elastic layer formation is a liquid, the material into a mold in which a cylindrical pipe, dies for holding the mandrel that are arranged at both ends of the pipe, and the mandrel are arranged, and curing the material by heating.

A resin layer may be further arranged on the rubber arranged on the peripheral surface of the mandrel. As a material for forming the resin layer and an electro-conductive agent, the following known ones may be used.

Examples of the resin include a fluorine resin, a polyamide resin, an acrylic urethane resin, a phenol resin, a melamine resin, a silicone resin, a urethane resin, a polyester resin, a polyvinyl acetal resin, an epoxy resin, a polyether resin, an amino resin, an acrylic resin, a urea resin, and mixtures thereof. As a production method involving arranging the resin layer, for example, there is given a method involving mixing and dispersing the resin in a solvent, and applying the resultant coating liquid onto the elastic layer.

As the electro-conductive agent, an ion conductive agent or an electro-conductive agent having added thereto carbon black may be used. For example, there are given carbon black having high electro-conductivity, such as EC300J and EC600JD (manufactured by Lion Corporation), and carbon black for rubber or carbon black for paint having a medium degree of electro-conductivity. From the viewpoints of dispersibility and electro-conductivity control, carbon black for paint is preferred. The volume resistivity of the resin layer is preferably from $1.0\times10^{6}$ Ω·cm to $1.0\times10^{12}$ Ω·cm, and hence the blending amount of the carbon black is preferably set to 3 mass % or more and 50 mass % or less with respect to the resin component.

When the electro-conductive agent is added to the resin of the resin layer, the resin having electro-conductivity imparted thereto serves as the electro-conductive portion. Accordingly, the roller of the present invention in which the insulating domains and the electro-conductive portion are exposed can be produced by adding electrically insulating particles to the resin in advance, followed by polishing, or by forming domains on the resin having electro-conductivity imparted thereto with an electrically insulating material or the like.

The solvent to be used for the coating liquid may be appropriately used under the condition that the resin to be used for the resin layer is dissolved. Specific examples of the solvent include ketones typified by methyl ethyl ketone and methyl isobutyl ketone; hydrocarbons typified by hexane and toluene; alcohols typified by methanol and isopropanol; esters; and water. A particularly preferred solvent is methyl ethyl ketone or methyl isobutyl ketone from the viewpoints of the solubility of the resin and a boiling point.

The thickness of the resin layer is preferably 4 μm or more and 50 μm or less, particularly preferably 5 μm or more and 45 μm or less. When the thickness is less than 4 μm, a photosensitive drum is liable to be contaminated through bleeding of a low-molecular-weight component in the elastic layer, and hence the surface layer may be peeled off. In addition, when the thickness is more than 50 μm, the developing roller may have so high a surface hardness as to wear the surface of the photosensitive drum.

(Electrophotographic Apparatus and Developing Apparatus)

Figure 5:
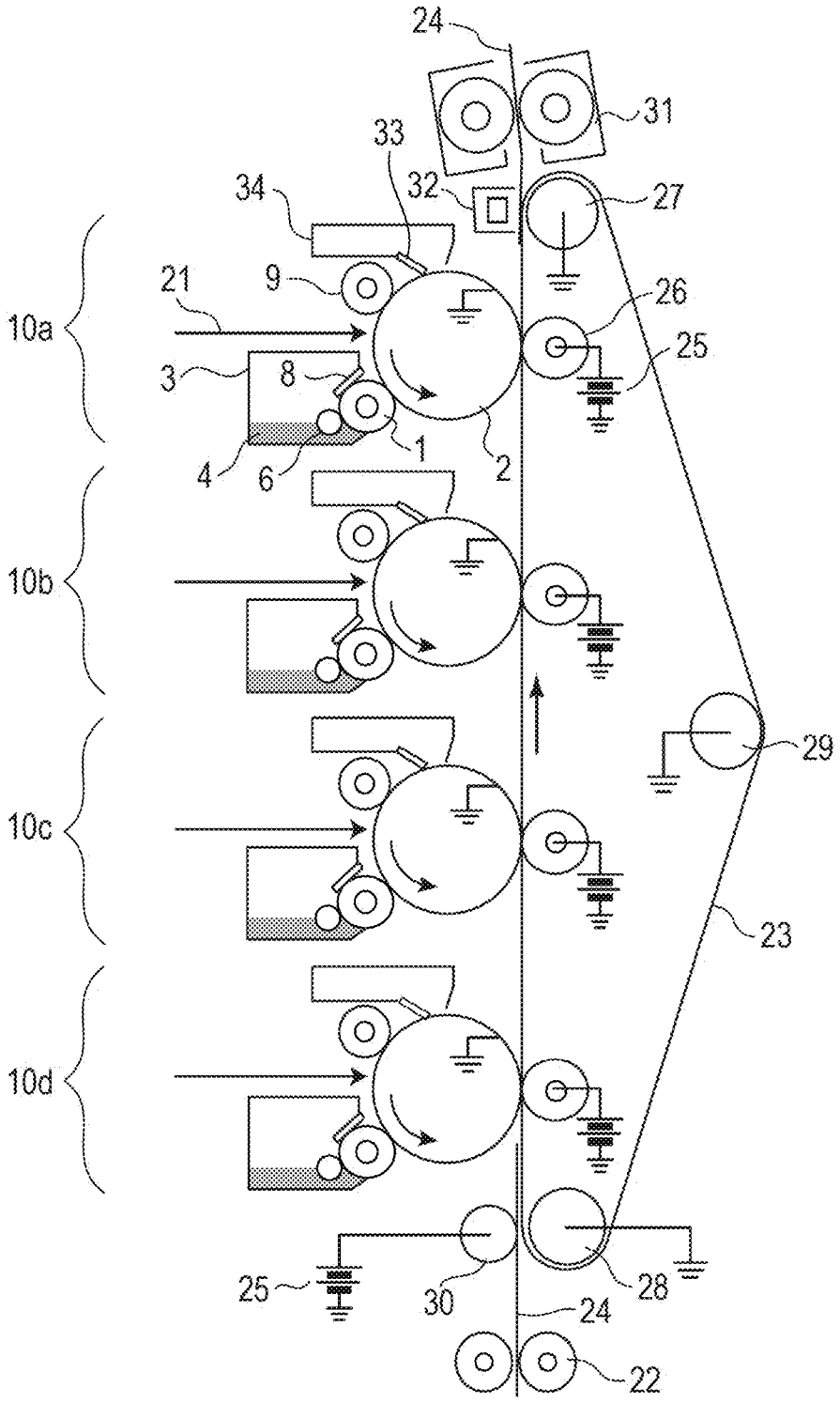
FIG. 5 is a schematic view of an electrophotographic apparatus according to one embodiment of the present invention.

FIG. 5 is an illustration of an example of an electrophotographic apparatus in which the member for electrophotography of the present invention can be used. In this example, the member for electrophotography of the present invention is used as a developing roller 1. A color electrophotographic apparatus illustrated in the schematic view of FIG. 5 includes developing apparatus (for respective colors) (10*a* to 10*d*) provided for respective color toners, i.e., yellow Y, magenta M, cyan C, and black BK in tandem.

The developing apparatus have the same basic constitution, though their specifications slightly differ from one another to some extent depending on the characteristics of the respective color toners. The developing apparatus each include a photosensitive drum 2 configured to rotate in an arrow direction. Around the photosensitive drum 2, a charging roller 9, an exposing unit (not shown), and a hopper 3 are arranged. The charging roller 9 is configured to uniformly charge the photosensitive drum 2. The exposing unit is configured to irradiate the uniformly charged photosensitive drum 2 with laser light 21 to form an electrostatic latent image. The hopper 3 is configured to supply toner to the photosensitive drum 2 having the electrostatic latent image formed thereon to develop the electrostatic latent image. Further arranged is a transfer member having a transfer roller 26 for transferring the toner image on the photosensitive drum 2 onto a recording medium (transfer material) 24, such as paper, which is fed by a sheet feeding roller 22 and conveyed by a conveying belt 23, by applying the voltage from a bias power source 25 from the rear surface of the recording medium 24.

The conveying belt 23 is suspended over a driver roller 27, a driven roller 28, and a tension roller 29, and is controlled to move in synchronization with the respective image forming portions to convey the recording medium 24 so that the toner images formed in the image forming portions may be sequentially transferred onto the recording medium 24 in a superimposed manner. The recording medium 24 is adapted to be conveyed by being electrostatically adsorbed by the conveying belt 23 through the action of an adsorbing roller 30, the roller being arranged immediately before the conveying belt 23.

In the electrophotographic apparatus, the photosensitive drum 2 and the developing roller 1 that is the roller for electrophotography of the present invention are arranged so as to be in contact with each other, and the photosensitive drum 2 and the developing roller 1 rotate in the same direction at the site of contact therebetween. Further, the electrophotographic apparatus includes: a fixing device 31 for fixing the toner images transferred onto the recording medium 24 in a superimposed manner through heating or the like; and a conveying device (not shown) for discharging the recording medium on which the images have been formed to the outside of the apparatus. The recording medium 24 is adapted to be peeled from the conveying belt 23 through the action of a peeling device 32 and then conveyed to the fixing device 31. Meanwhile, the developing apparatus each include a cleaning member having a cleaning blade 33 for removing transfer residual toner remaining on the photosensitive drum 2 without being transferred and a waste toner container 34 for storing toner stripped off the photosensitive member. The photosensitive drum 2 that has been cleaned is adapted to wait in an image-formable state.

Figure 6:
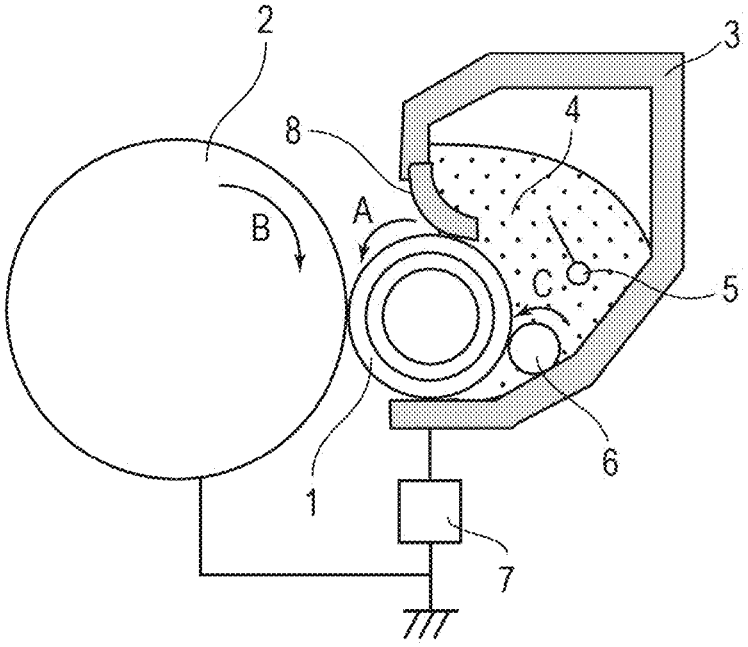
FIG. 6 is a schematic view of a developing apparatus according to one embodiment of the present invention.

Subsequently, FIG. 6 is an illustration of an example of each of the developing apparatus. In the developing apparatus, the photosensitive drum 2 serving as an electrostatic latent image bearing member for bearing an electrostatic latent image formed by a known process is rotated in an arrow B direction. A stirring blade 5 for stirring a nonmagnetic one-component toner 4 is arranged in the hopper 3 serving as a toner container. A toner-supplying member 6 for supplying the nonmagnetic one-component toner 4 to the developing roller 1 of the present invention and stripping the nonmagnetic one-component toner 4 present on the surface of the developing roller 1 after development abuts on the developing roller 1. When a supplying roller serving as the toner-supplying member rotates in the same direction (arrow C direction) as that of the developing roller 1 (arrow A direction), the surface of the toner-supplying/stripping roller moves in a counter direction against the surface of the developing roller 1. Thus, the nonmagnetic one-component toner 4 having the nonmagnetic toner particles supplied from the hopper 3 is supplied to the developing roller 1. A developing bias voltage is applied to the developing roller 1 by a developing bias power source 7 in order to move the nonmagnetic one-component toner 4 having the nonmagnetic toner particles carried on the developing roller 1.

The toner-supplying/stripping member 6 is preferably an elastic roller member made of a resin, a rubber, a sponge, or the like. Toner that has not been developed and transferred to the photosensitive drum 2 is stripped off the surface of the developing roller 1 by the toner-supplying/stripping member 6 for the moment, to thereby prevent the occurrence of immobile toner on the developing roller 1 and uniformize the charging of the nonmagnetic one-component toner 4.

A toner-regulating member 8 made of a material having rubber elasticity, such as a urethane rubber or a silicone rubber, or of a material having metal elasticity, such as phosphor bronze or stainless copper, may be used as a member for regulating the layer thickness of the nonmagnetic one-component toner 4 on the developing roller 1. An additionally thin toner layer can be formed on the developing roller 1 by bringing the toner-regulating member 8 into pressure contact with the surface of the developing roller 1 in a posture opposite to the rotation direction of the developing roller 1.

According to one embodiment of the present invention, the member for electrophotography that enables stable formation of a high-quality electrophotographic image even when used as a developing member over a long period of time can be obtained. In addition, according to other embodiments of the present invention, the developing apparatus and the electrophotographic image-forming apparatus each capable of stably forming a high-quality electrophotographic image can be obtained.

Example 1

Production of Roller for Electrophotography (Electro-Conductive Elastic Roller)

A solid mandrel made of stainless steel (SUS304) having a diameter of 6 mm was used as an electro-conductive support. A silane coupling primer (trade name: DY35-051, Dow Corning Toray Co., Ltd.) was applied onto the peripheral surface of the mandrel and then baked at a temperature of 150° C. for 40 minutes.

Next, the mandrel was concentrically arranged in a cylindrical metal mold, and then a liquid material for forming an elastic layer into which materials shown below had been dispersed was filled into a gap between the inner peripheral surface of the mold and the peripheral surface of the mandrel, followed by heating at a temperature of 120° C. for 40 minutes. After cooling, the mandrel was removed from the mold. Further, the mandrel was heated in an oven heated to a temperature of 200° C. for 4 hours to produce an elastic roller having a thickness of 3 mm.

| | |
|---|---|
| Silicone rubber: XE15-645 A (trade name, Momentive Performance Materials Japan LLC) | 50 parts by mass |
| Silicone rubber: XE15-645 B (trade name, Momentive Performance Materials Japan LLC) | 50 parts by mass |
| Carbon black: DENKA BLACK (powdery) (trade name, Denki Kagaku Kogyo Kabushiki Kaisha) | 6 parts by mass |

Next, a second elastic layer (resin layer) was formed on the peripheral surface of the elastic roller as described below. That is, the following materials were weighed out, and MEK was added, followed by thorough dispersion.

| | |
|---|---|
| Polyol: N5120 (trade name, Nippon Polyurethane industry) | 84 parts by mass |
| Isocyanate: L-55E (trade name, Nippon Polyurethane Industry) | 16 parts by mass |
| Carbon black: MA100 (trade name, Mitsubishi Chemical Corporation) | 20 parts by mass |

The resultant mixture was loaded into an overflow-type circulating applying device. The elastic roller was immersed in the applying device and lifted, followed by air drying for 40 minutes. After that, the resultant was heated at a temperature of 150° C. for 4 hours to form a resin layer having a thickness of 20 μm. Thus, an electro-conductive elastic roller was produced.

Convex-shaped insulating domains were formed on the peripheral surface of the electro-conductive elastic roller as described below. That is, the following materials were mixed.

| | |
|---|---|
| Acrylic compound: neopentyl glycol diacrylate (trade name: A-NPG, manufactured by Shin-Nakamura Chemical Co., Ltd.) | 100 parts by mass |
| Initiator: 1-hydroxy-cyclohexyl phenyl ketone (trade name: IRGACURE 184, manufactured by Toyotsu Chemiplas Corporation) | 5 parts by mass |

The mixture was applied onto the peripheral surface of the electro-conductive elastic roller using a jet dispenser device (trade name: NANO MASTER SMP-3, manufactured by Musashi Engineering, Inc.).

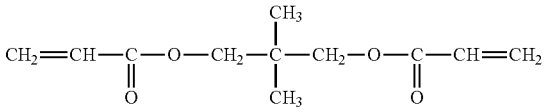

Neopentyl Glycol Diacrylate

After that, the above-mentioned roller having the mixture applied thereonto was set to a jig capable of rotating the roller in its circumferential direction. While the roller was rotated in its circumferential direction, the roller was irradiated with ultraviolet light using a high-pressure mercury lamp (trade name: Handy-type UV Curing Device, manufactured by Marionetwork) so as to achieve a cumulative light quantity of 1,500 mJ/cm$^2$, to thereby cure the insulating domains. Thus, an electro-conductive elastic roller of Example 1 was obtained. The surface of the resultant electro-conductive elastic roller was observed using an optical microscope (trade name: Laser Microscope VK8710, manufactured by Keyence Corporation). As a result of the observation, it was found that convex-shaped insulating domains having a diameter of 84 μm were formed on an electro-conductive portion at an interval of 53 μm and the insulating domains and the electro-conductive portion were exposed. The diameter was measured for each of 20 insulating domains, and their average value was adopted. In addition, for the interval, distances at 20 sites between the insulating domains were measured, and their average value was adopted. The results are shown in Table 3A.

Evaluation of Roller for Electrophotography

The roller for electrophotography produced in Example 1 was mounted as a developing roller onto a modified process cartridge for a color laser printer (trade name: CLJ4525, manufactured by HP Inc.), and then the process cartridge was removably mounted onto the color laser printer. Then, the whole was left to stand under an environment having a temperature of 15° C. and a relative humidity of 10% for 24 hours. Next, an entire surface solid image was output on one sheet under the same environment, and then the following steps were repeated 25 times.

1. An image having a print percentage of 0.5% was output on each of 1,000 sheets.
2. An entire surface solid image was output on one sheet.

After that, the image density of the resultant entire surface solid image on each of the 26 sheets in total was measured using a spectral densitometer: X-Rite 504 (trade name, S.D.G K.K.). For the image density, an average value for measurement at 15 points in the entire surface solid image on each sheet was adopted. Image densities at different numbers of output sheets were compared, and evaluation was performed based on criteria described in Table 1. The result is shown in Table 3A. (The image density of the first output solid image is hereinafter referred to as "image density on the 1st sheet," and the image density of the solid image output in the Xth step is hereinafter referred to as "image density on the Xth sheet.")

TABLE 1

| Evaluation rank | Evaluation criteria |
|---|---|
| A | The difference between the image density on the 1st sheet and the image density or the 20th sheet is less than 0.1, and the difference between the image density on the 1st sheet and the image density on the 25th sheet is less than 0.1. |

TABLE 1-continued

| Evaluation rank | Evaluation criteria |
|---|---|
| B | The difference between the image density on the 1st sheet and the image density on the 20th sheet is less than 0.1, and the difference between the image density on the 1st sheet and the image density on the 25th sheet is 0.1 or more and less than 0.2. |
| C | The difference between the image density on the 1st sheet and the image density on the 20th sheet is less than 0.1, and the difference between the image density on the 1st sheet and the image density on the 25th sheet is 0.2 or more. |
| D | The difference between the image density on the 1st sheet and the image density on the 20th sheet is 0.1 or more and less than 0.2, and the difference between the image density on the 1st sheet and the image density on the 25th sheet is 0.2 or more. |
| E | The difference between the image density on the 1st sheet and the image density on the 20th sheet is 0.2 or more and less than 0.3. |
| F | The difference between the image density on the 1st sheet and the image density on the 20th sheet is 0.3 or more. |

Measurement of Extraction Amount

The insulating domains formed on the electro-conductive elastic roller of Example 1 were scraped off, and the mass M1 of the insulating domains scraped off was measured. After that, the insulating domains were placed in a container made of filter paper, and the container was set in a Soxhlet extractor. MEK was used as a solvent, and reflux was performed for 36 hours to provide an extract solution. The MEK was removed from the resultant extract solution using an evaporator, and the mass M2 of the resultant residue was measured. Then, an extraction amount was calculated by the following numerical expression (1). The calculated extraction amount is shown in Table 3A.

$$(M2/M1)*100 \qquad \text{Numerical expression (1)}$$

Measurement of Volume Resistivity of Insulating Domains

A sheet having a thickness of 25 μm was produced on an aluminum sheet having a thickness of 0.2 mm by applying the same material as that used in the insulating domains through the use of a bar coater. The sheet was measured for its volume resistivity with an electrometer (trade name: Digital Electrometer 8252, manufactured by ADC Corporation). The result is shown in Table 3A.

Measurement of Taber Abrasion Loss Amount

A sheet having a thickness of 42 μm was produced on an aluminum sheet having a thickness of 0.2 mm by applying the same material as that used in the insulating domains through the use of a bar coater. The sheet was measured for its Taber abrasion loss amount with a Taber abrasion tester (trade name: Rotary Abrasion Tester, manufactured by Toyo Seiki Seisaku-sho, Ltd.) under the conditions of a load of 9.8 N, a number of rotations of 60 rpm, and a number of times of the test of 2,000. The result is shown in Table 3A.

Example 2

The same procedure as that of Example 1 was performed except that 100 parts by mass of neopentyl glycol diacrylate was changed to 50 parts by mass of neopentyl glycol diacrylate and 50 parts by mass of isooctyl acrylate (trade name: SR440, manufactured by Tomoe Engineering Co., Ltd.). The results are shown in Table 3A.

Example 3

The same procedure as that of Example 1 was performed except that 100 parts by mass of neopentyl glycol diacrylate was changed to 30 parts by mass of decanediol diacrylate (trade name: A-DOD-N, manufactured by Shin-Nakamura Chemical Co., Ltd.) and 70 parts by mass of stearyl acrylate (trade name: SR257, manufactured by Tomoe Engineering Co., Ltd.). The results are shown in Table 3A.

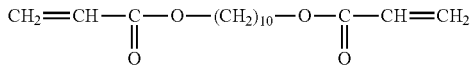

1,10-Decanediol Diacrylate

Example 4

The same procedure as that of Example 1 was performed except that 100 parts by mass of neopentyl glycol diacrylate was changed to 100 parts by mass of pentaerythritol tetraacrylate (trade name: A-TMMT, manufactured by Shin-Nakamura Chemical Co., Ltd.). The results are shown in Table 3A.

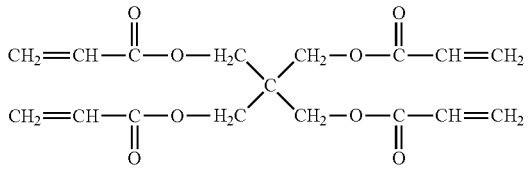

Pentaerythritol Tetraacrylate

Example 5

The same procedure as that of Example 1 was performed except that 100 parts by mass of neopentyl glycol diacrylate was changed to 50 parts by mass of dipentaerythritol polyacrylate (trade name: A-DPH, manufactured by Shin-Nakamura Chemical Co., Ltd.) and 50 parts by mass of lauryl acrylate (trade name: SR335, manufactured by Tomoe Engineering Co., Ltd.). The results are shown in Table 3A.

Example 6

The same procedure as that of Example 1 was performed except that 100 parts by mass of neopentyl glycol diacrylate was changed to 30 parts by mass of dipentaerythritol polyacrylate (trade name: A-DPH, manufactured by Shin-Nakamura Chemical Co., Ltd.) and 70 parts by mass of isooctyl acrylate (trade name: SR440, manufactured by Tomoe Engineering Co., Ltd.). The results are shown in Table 3A.

Example 7

The same procedure as that of Example 1 was performed except that 100 parts by mass of neopentyl glycol diacrylate was changed to 100 parts by mass of dendrimer acrylate (trade name: Viscoat 1000, manufactured by Osaka Organic Chemical Industry Ltd.). The results are shown in Table 3A.

Example 8

The same procedure as that of Example 1 was performed except that 100 parts by mass of neopentyl glycol diacrylate was changed to 50 parts by mass of dendrimer acrylate (trade name: Viscoat 1000, manufactured by Osaka Organic Chemical Industry Ltd.) and 50 parts by mass of lauryl acrylate (trade name: SR335, manufactured by Tomoe Engineering Co., Ltd.). The results are shown in Table 3A.

Example 9

The same procedure as that of Example 1 was performed except that 100 parts by mass of neopentyl glycol diacrylate was changed to 30 parts by mass of dendrimer acrylate (trade name: Viscoat 1000, manufactured by Osaka Organic Chemical Industry Ltd.) and 70 parts by mass of stearyl acrylate (trade name: SR257, manufactured by Tomoe Engineering Co., Ltd.). The results are shown in Table 3A.

Example 10

The same procedure as that of Example 1 was performed except that 100 parts by mass of neopentyl glycol diacrylate was changed to 100 parts by mass of ethylene glycol dimethacrylate (trade name: SR206, manufactured by Tomoe Engineering Co., Ltd.). The results are shown in Table 3A.

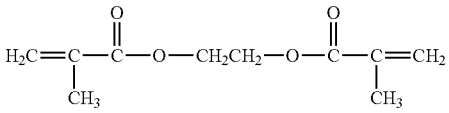

Ethylene Glycol Dimethacrylate

Example 11

The same procedure as that of Example 1 was performed except that 100 parts by mass of neopentyl glycol diacrylate was changed to 50 parts by mass of ethylene glycol dimethacrylate (trade name: SR206, manufactured by Tomoe Engineering Co., Ltd.) and 50 parts by mass of isooctyl acrylate (trade name: SR440, manufactured by Tomoe Engineering Co., Ltd.). The results are shown in Table 3A.

Example 12

The same procedure as that of Example 1 was performed except that 100 parts by mass of neopentyl glycol diacrylate was changed to 100 parts by mass of polybutadiene acrylate (trade name: CN307, manufactured by Tomoe Engineering Co., Ltd.). The results are shown in Table 3A.

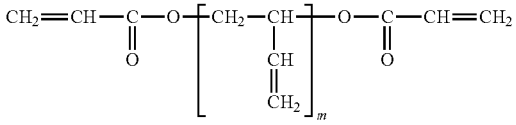

Polybutadiene Acrylate

Example 13

The same procedure as that of Example 1 was performed except that 100 parts by mass of neopentyl glycol diacrylate was changed to 50 parts by mass of polybutadiene methacrylate (trade name: EMA-3000, manufactured by Nippon Soda Co., Ltd.) and 50 parts by mass of isooctyl acrylate (trade name: SR440, manufactured by Tomoe Engineering Co., Ltd.). The results are shown in Table 3A.

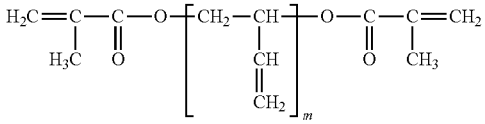

Polybutadiene Methacrylate

Example 14

The same procedure as that of Example 1 was performed except that 100 parts by mass of neopentyl glycol diacrylate was changed to 100 parts by mass of polyurethane acrylate (trade name: AU2090, manufactured by Tokushiki Co., Ltd.). The results are shown in Table 3A.

Example 15

The same procedure as that of Example 1 was performed except that 100 parts by mass of neopentyl glycol diacrylate was changed to 50 parts by mass of polyurethane acrylate (trade name: AU2090, manufactured by Tokushiki Co., Ltd.) and 50 parts by mass of stearyl acrylate (trade name: SR257, manufactured by Tomoe Engineering Co., Ltd.). The results are shown in Table 3A.

Example 16

The same procedure as that of Example 1 was performed except that 100 parts by mass of neopentyl glycol diacrylate was changed to 100 parts by mass of polyurethane acrylate (trade name: CN9010, manufactured by Tomoe Engineering Co., Ltd.). The results are shown in Table 3A.

Example 17

The same procedure as that of Example 1 was performed except that 100 parts by mass of neopentyl glycol diacrylate was changed to 50 parts by mass of polyurethane acrylate (trade name: CN9010, manufactured by Tomoe Engineering Co., Ltd.) and 50 parts by mass of stearyl acrylate (trade name: SR257, manufactured by Tomoe Engineering Co., Ltd.). The results are shown in Table 3A.

Example 18

The same procedure as that of Example 1 was performed except that 100 parts by mass of neopentyl glycol diacrylate was changed to 100 parts by mass of polyester acrylate (trade name: CN294, manufactured by Tomoe Engineering Co., Ltd.). The results are shown in Table 3A.

Example 19

The same procedure as that of Example 1 was performed except that 100 parts by mass of neopentyl glycol diacrylate was changed to 50 parts by mass of polyester acrylate (trade name: CN294, manufactured by Tomoe Engineering Co., Ltd.) and 50 parts by mass of lauryl acrylate (trade name: SR335, manufactured by Tomoe Engineering Co., Ltd.). The results are shown in Table 3A.

Example 20

The same procedure as that of Example 1 was performed except that 100 parts by mass of neopentyl glycol diacrylate was changed to 100 parts by mass of polyester acrylate (trade name: CN293, manufactured by Tomoe Engineering Co., Ltd.). The results are shown in Table 3A.

Example 21

The same procedure as that of Example 1 was performed except that 100 parts by mass of neopentyl glycol diacrylate was changed to 50 parts by mass of polyester acrylate (trade name: CN293, manufactured by Tomoe Engineering Co., Ltd.) and 50 parts by mass of lauryl acrylate (trade name: SR335, manufactured by Tomoe Engineering Co., Ltd.). The results are shown in Table 3A.

Example 22

The same procedure as that of Example 1 was performed except that 100 parts by mass of neopentyl glycol diacrylate was changed to 100 parts by mass of epoxy acrylate (trade name: CN111, manufactured by Tomoe Engineering Co., Ltd.). The results are shown in Table 3A.

Example 23

The same procedure as that of Example 1 was performed except that 100 parts by mass of neopentyl glycol diacrylate was changed to 50 parts by mass of epoxy acrylate (trade name: EBECRYL 860, manufactured by Daicel-allnex Ltd.) and 50 parts by mass of isooctyl acrylate (trade name: SR440, manufactured by Tomoe Engineering Co., Ltd.). The results are shown in Table 3A.

Example 24

The same procedure as that of Example 1 was performed except that 100 parts by mass of neopentyl glycol diacrylate was changed to 100 parts by mass of propoxylated bisphenol A diacrylate (trade name: A-BPP-3, manufactured by Shin-Nakamura Chemical Co., Ltd.). The results are shown in Table 3B.

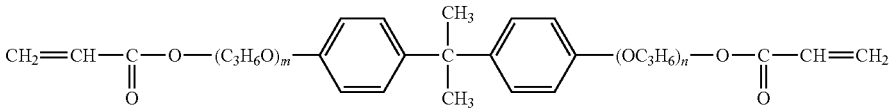

Propoxylated Bisphenol A Diacrylate

Example 25

The same procedure as that of Example 1 was performed except that 100 parts by mass of neopentyl glycol diacrylate was changed to 50 parts by mass of ethoxylated bisphenol A diacrylate (trade name: A-BPE-2, manufactured by Shin-Nakamura Chemical Co., Ltd.) and 50 parts by mass of stearyl acrylate (trade name: SR257, manufactured by Tomoe Engineering Co., Ltd.). The results are shown in Table 3B.

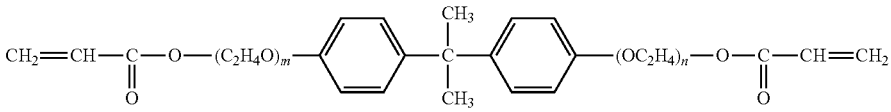

m+n = 2

Ethoxylated Bisphenol A Diacrylate

Example 26

The same procedure as that of Example 1 was performed except that 100 parts by mass of neopentyl glycol diacrylate was changed to 100 parts by mass of cyclohexanedimethanol diacrylate (trade name: CD401, manufactured by Tomoe Engineering Co., Ltd.). The results are shown in Table 3B.

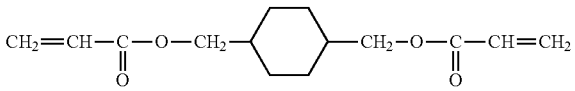

Cyclohexanedimethanol Diacrylate

Example 27

The same procedure as that of Example 1 was performed except that 100 parts by mass of neopentyl glycol diacrylate was changed to 50 parts by mass of cyclohexanedimethanol diacrylate (trade name: CD401, manufactured by Tomoe Engineering Co., Ltd.) and 50 parts by mass of lauryl acrylate (trade name: SR335, manufactured by Tomoe Engineering Co., Ltd.). The results are shown in Table 3B.

Example 28

The same procedure as that of Example 1 was performed except that 100 parts by mass of neopentyl glycol diacrylate was changed to 100 parts by mass of tricyclo[5.2.1.$0^{2,6}$] decanedimethanol diacrylate (trade name: A-DCP, manufactured by Shin-Nakamura Chemical Co., Ltd.). The results are shown in Table 3B.

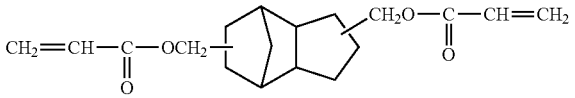

Tricyclo[5.2.1.$0^{2,6}$]Decanedimethanol Diacrylate

Example 29

The same procedure as that of Example 1 was performed except that 100 parts by mass of neopentyl glycol diacrylate was changed to 50 parts by mass of tricyclo[5.2.1.$0^{2,6}$] decanedimethanol diacrylate (trade name: A-DCP, manufactured by Shin-Nakamura Chemical Co., Ltd.) and 50 parts by mass of isooctyl acrylate (trade name: SR440, manufactured by Tomoe Engineering Co., Ltd.). The results are shown in Table 3B.

Example 30

The same procedure as that of Example 1 was performed except that 100 parts by mass of neopentyl glycol diacrylate was changed to 100 parts by mass of aromatic-containing polyurethane acrylate (trade name: CN992, manufactured by Tomoe Engineering Co., Ltd.). The results are shown in Table 3B.

Example 31

The same procedure as that of Example 1 was performed except that 100 parts by mass of neopentyl glycol diacrylate was changed to 50 parts by mass of aromatic-containing polyurethane acrylate (trade name: CN997, manufactured by Tomoe Engineering Co., Ltd.) and 50 parts by mass of lauryl acrylate (trade name: SR335, manufactured by Tomoe Engineering Co., Ltd.). The results are shown in Table 3B.

Example 32

The same procedure as that of Example 1 was performed except that 100 parts by mass of neopentyl glycol diacrylate was changed to 100 parts by mass of aromatic-containing epoxy acrylate (trade name: EBECRYL 3700, manufactured by Daicel-allnex Ltd.). The results are shown in Table 3B.

Example 33

The same procedure as that of Example 1 was performed except that 100 parts by mass of neopentyl glycol diacrylate was changed to 50 parts by mass of aromatic-containing epoxy acrylate (trade name: EA-1020, manufactured by Shin-Nakamura Chemical Co., Ltd.) and 50 parts by mass of isooctyl acrylate (trade name: SR440, manufactured by Tomoe Engineering Co., Ltd.). The results are shown in Table 3B.

Example 34

The same procedure as that of Example 1 was performed except that 100 parts by mass of neopentyl glycol diacrylate was changed to 100 parts by mass of aromatic-containing polyester acrylate (trade name: CN296, manufactured by Tomoe Engineering Co., Ltd.). The results are shown in Table 3B.

Example 35

The same procedure as that of Example 1 was performed except that 100 parts by mass of neopentyl glycol diacrylate was changed to 50 parts by mass of aromatic-containing polyester acrylate (trade name: CN2254, manufactured by Tomoe Engineering Co., Ltd.) and 50 parts by mass of lauryl acrylate (trade name: SR335, manufactured by Tomoe Engineering Co., Ltd.). The results are shown in Table 3B.

Example 36

A roller for electrophotography was produced by the following production method instead of the step of forming the second elastic layer (resin layer) and the step of forming the insulating domains on the electro-conductive elastic roller using a jet dispenser.

That is, a mixture of the following materials was dropped on a square plate made of Teflon (trademark), and sufficiently leveled.

| | |
|---|---|
| Acrylic compound: neopentyl glycol diacrylate (trade name: A-NPG, manufactured by Shin-Nakamura Chemical Co., Ltd.) | 100 parts by mass |
| Polymerization initiator: 1-hydroxy-cyclohexyl phenyl ketone (trade name: IRGACURE 184, manufactured by Toyotsu Chemiplas Corporation) | 5 parts by mass |

After that, the resultant was irradiated with ultraviolet light using a high-pressure mercury lamp (trade name: Handy-type UV Curing Device, manufactured by Marionetwork) so as to achieve a cumulative light quantity of 1,500 mJ/cm$^2$, to thereby produce a sheet. The sheet was pulverized using an agate mortar (trade name: Agate Mortar AM70, manufactured by Ito Seisakusho Co., Ltd.) into powder. After that, the powder was classified using a sieve having an opening of 106 μm (trade name: Sieve for R40/3 Test, manufactured by Kansai Wire Netting Co., Ltd.).

The resultant powder was measured for its volume-average particle diameter through observation using an optical microscope (trade name: Laser Microscope VK8710, manufactured by Keyence Corporation). The volume-average particle diameter of the powder was 78 μm. For the volume-average particle diameter, the diameters of 50 particles of the powder were measured, and their average value was adopted.

Next, a second elastic layer (resin layer) was formed on the peripheral surface of the elastic roller as described below. That is, the following materials were weighed out, and MEK was added, followed by thorough dispersion. The resultant mixture was loaded into an overflow-type circulating applying device.

| | |
|---|---|
| Polyol: N5120 (trade name, manufactured by Nippon Polyurethane Industry Co., Ltd.) | 84 parts by mass |
| Isocyanate: L-55E (trade name, manufactured by Nippon Polyurethane Industry Co., Ltd.) | 16 parts by mass |
| Carbon black: MA100 (trade name, manufactured by Mitsubishi Chemical Corporation) | 20 parts by mass |
| Powder obtained by pulverizing the above-mentioned sheet using a mortar | 30 parts by mass |

The elastic roller was immersed in the applying device and lifted, followed by air drying for 40 minutes. After that, the resultant was heated at a temperature of 150° C. for 4 hours to form a resin layer having a thickness of 20 μm. Thus, an electro-conductive elastic roller was produced. After that, its surface was polished using a rubber roller mirror plane processing machine (trade name: SZC, manufactured by Minakuchi Machinery Works Ltd.). Thus, a roller in which insulating domains and an electro-conductive portion were exposed (a roller in which exposed surfaces of the insulating domains and the exposed surface of the electro-conductive portion were in a so-called flush state, as illustrated in FIG. 2) was produced. The surface of the resultant electro-conductive elastic roller was observed using an optical microscope (trade name: Laser Microscope VK8710, manufactured by Keyence Corporation). As a result of the observation, it was found that insulating domains having a diameter of 66 μm were formed at an interval of 47 μm and the insulating domains and the electro-conductive portion were exposed. The diameter was measured for each of 20 insulating domains, and their average value was adopted. In addition, for the interval, distances at 20 sites between the insulating domains were measured, and their average value was adopted. The results are shown in Table 3B. In addition, the evaluation of the roller for electrophotography, and the measurement of the extraction amount, the volume resistivity, and the Taber abrasion loss amount were performed in the same manner as in Example 1. The results are shown in Table 3B.

Example 37

The same procedure as that of Example 36 was performed except that 100 parts by mass of neopentyl glycol diacrylate was changed to 50 parts by mass of neopentyl glycol diacrylate and 50 parts by mass of isooctyl acrylate (trade name: SR440, manufactured by Tomoe Engineering Co., Ltd.). The results are shown in Table 3B.

Example 38

The same procedure as that of Example 36 was performed except that 100 parts by mass of neopentyl glycol diacrylate was changed to 100 parts by mass of pentaerythritol tetraacrylate (trade name: A-TMMT, manufactured by Shin-Nakamura Chemical Co., Ltd.). The results are shown in Table 3B.

Example 39

The same procedure as that of Example 36 was performed except that 100 parts by mass of neopentyl glycol diacrylate was changed to 50 parts by mass of dipentaerythritol polyacrylate (trade name: A-DPH, manufactured by Shin-Nakamura Chemical Co., Ltd.) and 50 parts by mass of lauryl acrylate (trade name: SR335, manufactured by Tomoe Engineering Co., Ltd.). The results are shown in Table 3B.

Example 40

The same procedure as that of Example 1 was performed except that 100 parts by mass of neopentyl glycol diacrylate was changed to 50 parts by mass of neopentyl glycol diacrylate and 50 parts by mass of ethoxylated bisphenol A diacrylate (trade name: A-BPE-2, manufactured by Shin-Nakamura Chemical Co., Ltd.). The results are shown in Table 3B.

Example 41

The same procedure as that of Example 1 was performed except that 100 parts by mass of neopentyl glycol diacrylate was changed to 50 parts by mass of epoxy acrylate (trade name: EBECRYL 860, manufactured by Daicel-allnex Ltd.) and 50 parts by mass of neopentyl glycol diacrylate. The results are shown in Table 3B.

Example 42

The same procedure as that of Example 1 was performed except that 100 parts by mass of neopentyl glycol diacrylate was changed to 50 parts by mass of aromatic-containing polyester acrylate (trade name: CN296, manufactured by Tomoe Engineering Co., Ltd.) and 50 parts by mass of neopentyl glycol diacrylate. The results are shown in Table 3B.

Comparative Example 1

The same procedure as that of Example 1 was performed except that 100 parts by mass of neopentyl glycol diacrylate was changed to 100 parts by mass of methyl methacrylate (MMA monomer, manufactured by Mitsubishi Chemical Corporation). The results are shown in Table 3B.

Comparative Example 2

The same procedure as that of Example 1 was performed except that 100 parts by mass of neopentyl glycol diacrylate was changed to 100 parts by mass of isooctyl acrylate (trade name: SR440, manufactured by Tomoe Engineering Co., Ltd.). The results are shown in Table 3B.

Comparative Example 3

The same procedure as that of Example 1 was performed except that 100 parts by mass of neopentyl glycol diacrylate was changed to 100 parts by mass of stearyl acrylate (trade name: SR257, manufactured by Tomoe Engineering Co., Ltd.). The results are shown in Table 3B.

The materials for the insulating domains used in Examples 1 to 42 and Comparative Examples 1 to 3 are shown in Tables 2A and 2B.

TABLE 2A

| | | Bifunctional or higher acrylate (1) | | | |
|---|---|---|---|---|---|
| | | Material name | Number of functional groups | Monofunctional acrylate (2) Material name | (1):(2) (Mass ratio) |
| Example | 1 | Neopentyl glycol diacrylate | 2 | None | 100:0 |
| | 2 | Neopentyl glycol diacrylate | 2 | Isooctyl acrylate | 50:50 |
| | 3 | Decanediol diacrylate | 2 | Stearyl acrylate | 30:70 |
| | 4 | Pentaerythritol tetraacrylate | 4 | None | 100:0 |
| | 5 | Dipentaerythritol polyacrylate | 6 | Lauryl acrylate | 50:50 |
| | 6 | Dipentaerythritol polyacrylate | 6 | Isooctyl acrylate | 30:70 |
| | 7 | Dendrimer acrylate | 25 | None | 100:0 |
| | 8 | Dendrimer acrylate | 25 | Lauryl acrylate | 50:50 |
| | 9 | Dendrimer acrylate | 25 | Stearyl acrylate | 30:70 |
| | 10 | Ethylene glycol dimethacrylate | 2 | None | 100:0 |
| | 11 | Ethylene glycol dimethacrylate | 2 | Isooctyl acrylate | 50:50 |
| | 12 | Polybutadiene acrylate | 2 | None | 100:0 |
| | 13 | Polybutadiene methacrylate | 2 | Isooctyl acrylate | 50:50 |
| | 14 | Polyurethane acrylate | 2 | None | 100:0 |
| | 15 | Polyurethane acrylate | 2 | Stearyl acrylate | 50:50 |
| | 16 | Polyurethane acrylate | 6 | None | 100:0 |
| | 17 | Polyurethane acrylate | 6 | Stearyl acrylate | 50:50 |
| | 18 | Polyester acrylate | 4 | None | 100:0 |
| | 19 | Polyester acrylate | 4 | Lauryl acrylate | 50:50 |
| | 20 | Polyester acrylate | 6 | None | 100:0 |
| | 21 | Polyester acrylate | 6 | Lauryl acrylate | 50:50 |
| | 22 | Epoxy acrylate | 3 | None | 100:0 |
| | 23 | Epoxy acrylate | 4 | Isooctyl acrylate | 50:50 |

TABLE 2B

| | | Bifunctional or higher acrylate (1) | | | |
|---|---|---|---|---|---|
| | | Material name | Number of functional groups | Monofunctional acrylate (2) Material name | (1):(2) (Mass ratio) |
| Example | 24 | Propoxylated bisphenol A diacrylate | 2 | None | 100:0 |
| | 25 | Ethoxylated bisphenol A diacrylate | 2 | Stearyl acrylate | 50:50 |
| | 26 | Cyclohexanedimethanol diacrylate | 2 | None | 100:0 |
| | 27 | Cyclohexanedimethanol diacrylate | 2 | Lauryl acrylate | 50:50 |
| | 28 | Tricyclo[5.2.1.$0^{2,6}$]dec-anedimethanol diacrylate | | None | 100:0 |
| | 29 | Tricyclo[5.2.1.$0^{2,6}$]dec-anedimethanol diacrylate | 2 | Isooctyl acrylate | 50:50 |
| | 30 | Aromatic-containing polyurethane acrylate | 2 | None | 100:0 |
| | 31 | Aromatic-containing polyurethane acrylate | 6 | Lauryl acrylate | 50:50 |
| | 32 | Aromatic-containing epoxy acrylate | 2 | None | 100:0 |
| | 33 | Aromatic-containing epoxy acrylate | 2 | Isooctyl acrylate | 50:50 |
| | 34 | Aromatic-containing polyester acrylate | 6 | None | 100:0 |
| | 35 | Aromatic-containing polyester acrylate | 2 | Lauryl acrylate | 50:50 |

TABLE 2B-continued

| | | Bifunctional or higher acrylate (1) | | | |
|---|---|---|---|---|---|
| | | Material name | Number of functional groups | Monofunctional acrylate (2) Material name | (1):(2) (Mass ratio) |
| | 36 | Neopentyl glycol diacrylate | 2 | None | 100:0 |
| | 37 | Neopentyl glycol diacryate | 2 | Isooctyl acrylate | 50:50 |
| | 38 | Pentaerythritol tetraacrylate | 4 | None | 100:0 |
| | 39 | Dipentaerythritol polyacrylate | 6 | Lauryl acrylate | 50:50 |
| | 40 | Ethoxylated bisphenol A diacrylate/ neopentyl glycol diacrylate | 2/2 | None | 100:0 |
| | 41 | Epoxy acrylate/ neopentyl glycol diacrylate | 4/2 | None | 100:0 |
| | 42 | Aromatic-containing polyester acrylate/ neopentyl glycol diacrylate | 6/2 | None | 100:0 |
| Comparative Example | 1 | — | — | Methyl methacrylate | 0:100 |
| | 2 | — | — | Isooctyl acrylate | 0:100 |
| | 3 | — | — | Stearyl acrylate | 0:100 |

TABLE 3A

| | | Measurement values and physical properties of insulating domains | | | | | | | |
|---|---|---|---|---|---|---|---|---|---|
| | | Diameter (μm) | Interval (μm) | Volume resistivity (Ω · cm) | Taber abrasion amount (mg) | *Number of carbon atoms of "R" of structural formula (1) | Presence or absence of aromatic or alicyclic structure | Extraction amount (%) | Evaluation rank of image |
| Example | 1 | 84 | 53 | 4.2E+14 | 5.2 | Yes | No | 6.4 | D |
| | 2 | 67 | 61 | 6.5E+14 | 8.6 | Yes | No | 14.9 | D |
| | 3 | 71 | 64 | 6.7E+14 | 12.1 | Yes | No | 18.2 | E |
| | 4 | 86 | 52 | 1.2E+14 | 5.1 | Yes | No | 6.7 | D |
| | 5 | 66 | 62 | 3.6E+14 | 8.5 | Yes | No | 14.8 | D |
| | 6 | 65 | 71 | 4.1E+14 | 13.1 | Yes | No | 18.6 | E |
| | 7 | 51 | 81 | 2.3E+14 | 5.0 | Yes | No | 6.8 | D |
| | 8 | 61 | 62 | 6.1E+14 | 8.4 | Yes | No | 14.6 | D |
| | 9 | 64 | 66 | 3.1E+14 | 12.6 | Yes | No | 18.7 | E |
| | 10 | 82 | 56 | 4.1E+13 | 5.1 | No | No | 6.7 | E |
| | 11 | 64 | 69 | 5.6E+13 | 8.6 | No | No | 14.1 | E |
| | 12 | 54 | 81 | 2.4E+15 | 4.6 | Yes | No | 7.2 | C |
| | 13 | 64 | 62 | 3.1E+15 | 6.9 | Yes | No | 14.3 | C |
| | 14 | 57 | 88 | 4.3E+14 | 4.2 | Yes | No | 7.3 | C |
| | 15 | 66 | 61 | 6.2E+14 | 6.6 | Yes | No | 14.9 | C |
| | 16 | 56 | 82 | 2.8E+14 | 4.5 | Yes | No | 6.7 | C |
| | 17 | 67 | 64 | 4.9E+14 | 6.9 | Yes | No | 14.6 | C |
| | 18 | 53 | 88 | 4.1E+14 | 4.6 | Yes | No | 7.3 | C |
| | 19 | 66 | 68 | 6.1E+14 | 6.6 | Yes | No | 14.7 | C |
| | 20 | 56 | 87 | 3.1E+14 | 4.7 | Yes | No | 7.2 | C |
| | 21 | 62 | 64 | 5.7E+14 | 6.9 | Yes | No | 13.9 | C |
| | 22 | 58 | 82 | 3.1E+14 | 4.5 | Yes | No | 7.5 | C |
| | 23 | 66 | 62 | 6.6E+14 | 7.1 | Yes | No | 14.9 | C |

*"Yes" represents a case where the number of carbon atoms is 4 or more, and "No" represents a case where the number of carbon atoms is 3 or less.

TABLE 3B

| | | Measurement values and physical properties of insulating domains | | | | | | | |
|---|---|---|---|---|---|---|---|---|---|
| | | Diameter (μm) | Interval (μm) | Volume resistivity (Ω · cm) | Taber abrasion amount (mg) | *Number of carbon atoms of "R" of structural formula (1) | Presence or absence of aromatic or alicyclic structure | Extraction amount (%) | Evaluation rank of image |
| Example | 24 | 66 | 67 | 3.1E+15 | 4.7 | Yes | Yes | 6.9 | B |
| | 25 | 72 | 61 | 2.6E+15 | 7.4 | Yes | Yes | 14.7 | B |
| | 26 | 81 | 54 | 3.4E+15 | 4.8 | Yes | Yes | 14.6 | B |
| | 27 | 69 | 61 | 1.6E+15 | 7.5 | Yes | Yes | 7.0 | B |
| | 28 | 82 | 51 | 7.8E+15 | 4.8 | Yes | Yes | 7.1 | B |
| | 29 | 64 | 67 | 6.9E+15 | 8.4 | Yes | Yes | 14.5 | B |
| | 30 | 61 | 67 | 1.6E+15 | 3.7 | Yes | Yes | 6.8 | A |
| | 31 | 68 | 61 | 2.1E+15 | 6.1 | Yes | Yes | 14.7 | A |
| | 32 | 61 | 68 | 6.8E+15 | 3.6 | Yes | Yes | 6.9 | A |
| | 33 | 66 | 61 | 5.9E+15 | 5.9 | Yes | Yes | 14.1 | A |
| | 34 | 66 | 64 | 4.6E+15 | 3.7 | Yes | Yes | 7.2 | A |
| | 35 | 65 | 57 | 5.5E+15 | 6.1 | Yes | Yes | 14.3 | A |
| | 36 | 64 | 47 | 4.2E+14 | 5.2 | Yes | No | 7.2 | E |
| | 37 | 71 | 41 | 6.5E+14 | 8.6 | Yes | No | 13.8 | E |
| | 38 | 72 | 45 | 1.2E+14 | 4.9 | Yes | No | 7.3 | E |
| | 39 | 62 | 50 | 3.6E+14 | 8.5 | Yes | No | 14.6 | E |
| | 40 | 84 | 56 | 1.5E+15 | 5.4 | Yes | Yes | 7.4 | B |
| | 41 | 81 | 54 | 5.5E+14 | 4.7 | Yes | No | 6.9 | C |
| | 42 | 84 | 55 | 2.1E+15 | 4.5 | Yes | Yes | 7.2 | A |
| Comparative Example | 1 | 64 | 61 | 2.3E+13 | 98.6 | No | No | 28.7 | F |
| | 2 | 62 | 66 | 5.5E+14 | 97.4 | No | No | 29.4 | F |
| | 3 | 69 | 64 | 3.6E+14 | 99.1 | No | No | 29.6 | F |

*"Yes" represents a case where the number of carbon atoms is 4 or more, and "No" represents a case where the number of carbon atoms is 3 or less.

In each of Examples 3, 6, 9, 10, and 11, an acrylate having two or more (meth)acryloyl groups in the molecule was used as a material for the insulating domains. The abrasion loss amount was able to be suppressed, and as a result, the reduction in image density of the solid image was able to be suppressed even when the printer was used for a long period of time.

In each of Examples 1, 2, 4, 5, 7, and 8, the extraction amount was suppressed to 15% or less. As a result, the abrasion loss amount was able to be suppressed more, and the reduction in image density was able to be suppressed more, than in Example 3, 6, or 9.

In each of Examples 1, 2, 4, and 5, the number of carbon atoms of the linking group R was set to 4 or more. As a result, the volume resistivity of the material for forming the insulating domains was increased, and the reduction in image density was suppressed more.

In each of Examples 12 to 23, a linking group containing at least one or more oligomer components selected from the group consisting of polybutadiene, polyurethane, polyester, and an epoxy resin was used as the linking group R. As a result, as compared to Example 1, 2, 4, or 5, the abrasion loss amount was able to be suppressed more, and the reduction in image density was able to be suppressed more.

Specifically, for example, the following was found.

Example 1 and Example 12 are different from each other in the presence or absence of polybutadiene in the polyfunctional acrylate, and identical to each other in having the same number of functional groups in the polyfunctional acrylate and using no monofunctional acrylate. In the comparison between Example 1 and Example 12, the Taber abrasion amount of Example 12 was further reduced as compared to that of Example 1.

Example 1 and Example 14 are different from each other in the presence or absence of polyurethane in the polyfunctional acrylate, and identical to each other in having the same number of functional groups in the polyfunctional acrylate and using no monofunctional acrylate. In the comparison between Example 1 and Example 14, the Taber abrasion amount of Example 14 was further reduced as compared to that of Example 1.

Example 4 and Example 18 are different from each other in the presence or absence of polyester in the polyfunctional acrylate, and identical to each other in having the same number of functional groups in the polyfunctional acrylate and using no monofunctional acrylate. In the comparison between Example 4 and Example 18, the Taber abrasion amount of Example 18 was further reduced as compared to that of Example 4.

In each of Examples 24 to 29, an acrylate having an aromatic or alicyclic structure was used as the linking group R. As a result, as compared to Example 1, 2, 4, or 5, the volume resistivity of the insulating domains was further increased, and the reduction in image density was able to be further suppressed.

Specifically, for example, the following was found.

Example 1 and Example 24 are identical to each other in having the same number of functional groups in the polyfunctional acrylate and using no monofunctional acrylate, but are different from each other in the presence or absence of an aromatic structure in the acrylate. In the comparison between Example 1 and Example 24, the volume resistivity of the insulating domains of Example 24 was further increased as compared to that of Example 1.

In each of Examples 30 to 35, polyurethane, polyester, or an epoxy resin having an aromatic structure was used as the linking group R. As a result, as compared to Examples 12 to 23, the volume resistivity of the insulating domains was further increased, and the abrasion loss amount was able to be suppressed as well. Accordingly, the reduction in image density was able to be further suppressed.

Example 14 and Example 30 are identical to each other in having the same number of functional groups in the polyfunctional acrylate and using no monofunctional acrylate, but are different from each other in the presence or absence of an aromatic structure in the polyurethane contained therein. In the comparison between Example 14 and Example 30, the volume resistivity of the insulating domains of Example 30 was further increased as compared to that of Example 14.

In each of Examples 36 to 39, a structure in which the insulating domains were embedded in the electro-conductive portion was adopted. As a result, as compared to Example 1, 2, 4, or 5, a slight reduction in image density was found. In each of Examples 1, 2, 4, and 5, the insulating domains were formed so as to form convex portions on the electro-conductive portion. It is considered that by virtue of this, the insulating domains forming the convex portions physically conveyed toner, and even when charge accumulated in the insulating domains was slightly reduced during use, the time-dependent reduction in density of the electrophotographic image was able to be suppressed more.

In each of Examples 40 to 42, two or more kinds of acrylates each having two or more (meth)acryloyl groups were used, but the suppressing effect on the density reduction was found to be unchanged.

Meanwhile, in each of Comparative Examples, a resin obtained by polymerizing a monomer having only one acryloyl group or methacryloyl group was used for the insulating domains. As a result, the image density was significantly reduced. This is probably because of the following reason. The insulating domains in the surface of the roller for electrophotography were significantly abraded to reduce the volume of the insulating domains. Consequently, the charge amount with which the insulating domains were charged was reduced and electric fields were weakened, with the result that a Coulomb force and a gradient force were reduced to reduce a toner-conveying force.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-198374, filed Oct. 6, 2015, which is hereby incorporated by reference herein in its entirety.

What is claimed is:

1. A member for electrophotography, comprising:

a support;

an electro-conductive elastic layer on the support; and a plurality of electrically insulating domains on the electro-conductive elastic layer, wherein a surface of the member for electrophotography includes surfaces of the electrically insulating domains with an exposed portion of the electro-conductive elastic layer free of being covered by the electrically insulating domains, and the electrically insulating domains contain a resin having a structure represented by formula (1):

$$A_nR \quad (1)$$

where n represents an integer of 2 or more, R represents a linking group that links n pieces of A and the linking group R contains an oligomer component of at least one resin selected from the group consisting of polyurethane, polyester, an epoxy resin, and polybutadiene, and A represents a structure represented by formula (2):

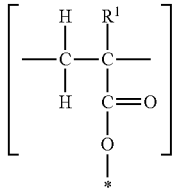

(2)

where $R^1$ represents a hydrogen atom or a methyl group, and symbol "*" represents a bonding site with the linking group R.

2. A member for electrophotography according to claim 1, wherein (M2/M1)*100≤15 where M2 represents a mass of a residue obtained by subjecting the electrically insulating domains having a mass M1 to reflux in a Soxhlet extractor for 36 hours using methyl ethyl ketone as a solvent, and removing the methyl ethyl ketone from the resultant extract solution.

3. A member for electrophotography according to claim 1, wherein the electrically insulating domains are each formed in a convex shape with respect to a surface of the electro-conductive elastic layer.

4. A member for electrophotography comprising:

a support;

an electro-conductive elastic layer on the support; and a plurality of electrically insulating domains on the electro-conductive elastic layer, wherein a surface of the member for electrophotography includes surfaces of the electrically insulating domains with an exposed portion of the electro-conductive elastic layer free of being covered by the electrically insulating domains, and the electrically insulating domains contain a resin having a structure represented by formula (1):

$$A_nR \quad (1)$$

where n represents an integer of 2 or more, R represents a linking group that links n pieces of A, and A represents a structure represented by formula (2):

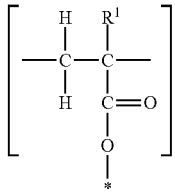

(2)

where $R^1$ represents a hydrogen atom or a methyl group, and symbol "*" represents a bonding site with the linking group R, and the linking group R has at least one of structures represented by formulae 3-1, 3-3, 3-4, 3-5, 3-8 and 3-9:

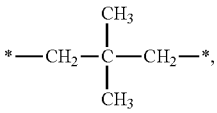

(3-1)

-continued (3-3)

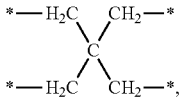

(3-4)

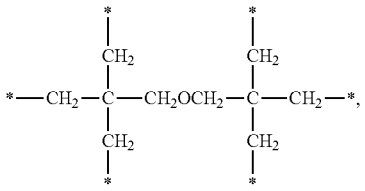

(3-5)

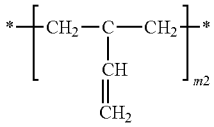

where m2 represents an integer of 15 to 60, (3-8)

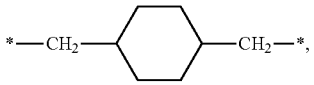

and (3-9)

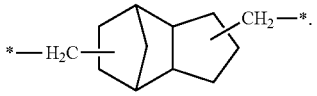

5. A developing apparatus, comprising a developing member, the developing member comprising:

a support;

an electro-conductive elastic layer on the support; and a plurality of electrically insulating domains on the electro-conductive elastic layer, wherein a surface of the member for electrophotography includes surfaces of the electrically insulating domains with an exposed portion of the electro-conductive elastic layer free of being covered by the electrically insulating domains, and the electrically insulating domains contain a resin having a structure represented by formula (1):

$$A_nR \quad (1)$$

where n represents an integer of 2 or more, R represents a linking group that links n pieces of A and the linking group R contains an oligomer component of at least one resin selected from the group consisting of polyurethane, polyester, an epoxy resin, and polybutadiene, and A represents a structure represented by formula (2):

(2)

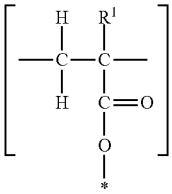

where $R^1$ represents a hydrogen atom or a methyl group, and symbol "*" represents a bonding site with the linking group R.

6. A developing apparatus comprising a developing member, the developing member comprising:

a support;

an electro-conductive elastic layer on the support; and a plurality of electrically insulating domains on the electro-conductive elastic layer, wherein a surface of the member for electrophotography includes surfaces of the electrically insulating domains with an exposed portion of the electro-conductive elastic layer free of being covered by the electrically insulating domains, and the electrically insulating domains contain a resin having a structure represented by formula (1):

$$A_nR \quad (1)$$

where n represents an integer of 2 or more, and R represents a linking group that links n pieces of A, and A represents a structure represented by formula (2):

(2)

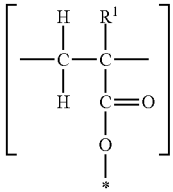

where $R^1$ represents a hydrogen atom or a methyl group, and symbol "*" represents a bonding site with the linking group R, and the linking group R has at least one of structures represented by formulae 3-1, 3-3, 3-4, 3-5, 3-8 and 3-9:

(3-1)

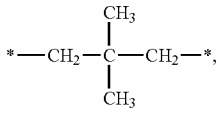

(3-3)

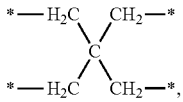

(3-4)

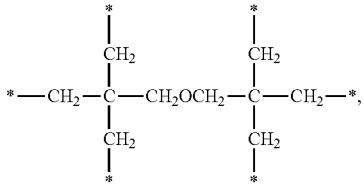

(3-5)

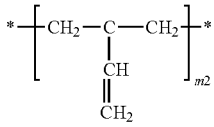

where m2 represents an integer of 15 to 60,
(3-8)
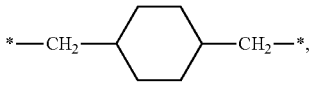
and
(3-9)
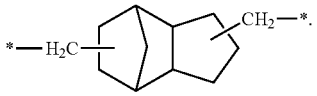
* * * * *